US011930933B2

(12) United States Patent
Stokesbary et al.

(10) Patent No.: US 11,930,933 B2
(45) Date of Patent: Mar. 19, 2024

(54) ADJUSTABLE BED BASE WITH INCLINE FEATURE

(71) Applicant: L&P Property Management Company, South Gate, CA (US)

(72) Inventors: Jason J. Stokesbary, Joplin, MO (US); Jacob J. Neuenswander, Carthage, MO (US); Isaac T. Freelend, Sarcoxie, MO (US); Galen B. Wilkinson, Carl Junction, MO (US)

(73) Assignee: L&P Property Management Company, South Gate, CA (US)

( * ) Notice: Subject to any disclaimer, the term of this patent is extended or adjusted under 35 U.S.C. 154(b) by 206 days.

(21) Appl. No.: 17/744,885

(22) Filed: May 16, 2022

(65) Prior Publication Data

US 2023/0363543 A1 Nov. 16, 2023

(51) Int. Cl.
*A47C 20/04* (2006.01)

(52) U.S. Cl.
CPC ..... *A47C 20/041* (2013.01)

(58) Field of Classification Search
CPC ..... A47C 20/041
USPC ..... 5/616
See application file for complete search history.

(56) References Cited

U.S. PATENT DOCUMENTS

| | | | | |
|---|---|---|---|---|
| 4,715,073 | A * | 12/1987 | Butler | A61G 7/005 5/607 |
| 5,294,179 | A * | 3/1994 | Rudes | A61G 5/14 297/DIG. 10 |
| 6,516,478 | B2 * | 2/2003 | Cook | A47C 19/045 5/616 |
| 6,957,456 | B2 * | 10/2005 | Darling | A47C 19/045 5/509.1 |
| 7,146,662 | B1 * | 12/2006 | Pollard | A47B 91/16 5/118 |
| 2003/0052238 | A1 * | 3/2003 | Schneider | A47C 20/08 248/421 |
| 2003/0172756 | A1 * | 9/2003 | Dewert | A47C 20/041 74/89.23 |

* cited by examiner

*Primary Examiner* — Justin C Mikowski
*Assistant Examiner* — Luke Hall
(74) *Attorney, Agent, or Firm* — Wood Herron & Evans LLP

(57) ABSTRACT

An adjustable bed base has a subframe assembly including a subframe which may be inclined relative to a stationary frame by a primary linear actuator. An articulating deck is attached to the subframe. Secondary linear actuators articulate the deck. The subframe assembly is pivotally secured to a portion of the stationary frame. The subframe may be inclined by extending the primary linear actuator which moves ramps, causing wheels attached to the subframe to ride upwardly along the ramps, thereby raising the head end of the subframe relative to the stationary frame.

20 Claims, 10 Drawing Sheets

ADJUSTABLE BED BASE WITH INCLINE FEATURE

FIELD OF THE INVENTION

This invention relates generally to bedding products and, more particularly, to an adjustable bed base having a subframe which may be tilted.

BACKGROUND OF THE INVENTION

Conventional adjustable bed bases often have a stationary frame supported by leg assemblies. Such adjustable bed bases typically include a deck supported by the stationary frame. The deck supports a mattress. The deck usually comprises multiple deck members hinged together. One of the deck members, commonly a seat deck member, is commonly fixedly secured to the stationary frame. A head deck member is typically hinged to the seat deck member. A first motorized linear actuator inclines the front end of the head deck member so a user may sit up and read or watch television in an inclined position.

A leg deck member is commonly hinged to the stationary seat deck member and a foot deck member hinged to the leg deck member. A second motorized linear actuator serves to incline the leg and foot deck members around a person's knees for comfort.

One drawback to such common adjustable bed bases is that the articulated deck is always horizontal when the deck members are aligned or flat. There is no mechanism to either incline or decline the articulated deck when the deck members are all flat and aligned. Persons with health issues such as circulation issues or gastroesophageal reflux disease ("GERD") issues may desire a flat platform which is inclined such that the head end is above the foot end of the platform. Other health conditions or situations may require that the flat platform be inclined such that the head end of the platform is above the foot end of the deck platform.

In view of the above, there is a need for an adjustable bed base having an adjustable frame. There is further a need for an adjustable bed base which is capable of inclining the articulated deck of the adjustable bed base when the articulated deck is flat or planar.

It is therefore an objective of this invention to provide an adjustable bed base having a frame which may be inclined.

It is further an objective of this invention to provide an adjustable bed base having an articulated deck which may be inclined when flat.

SUMMARY OF THE INVENTION

According to one aspect of the invention, an adjustable bed base comprises a generally rectangular stationary frame having opposed side rails, a head rail, a foot rail and a middle rail. Each of the side rails have a C-shaped cross-section defining a channel. Legs which may or may not be adjustable in height are secured to the stationary frame for supporting the stationary frame.

The adjustable bed base further comprises a subframe pivotally secured to the stationary frame which is movable relative to the stationary frame. The subframe comprises opposed side members, a front member, a rear member and a cross member extending between the opposed side members. Wheel mounting brackets are secured to the front member of the subframe. A rotatable wheel is secured to each of the wheel mounting brackets.

The adjustable bed base further comprises an articulated deck comprising a head deck board, a seat deck board, a leg deck board and a foot deck board hinged together. The seat deck board is secured to the side members of the subframe and remains stationary regardless of the positions of the other deck boards. The boards may be made of wood, plastic or any known material. A head brace is secured to the head deck board and a leg brace is secured to the leg deck board. In one embodiment, the head and leg braces are generally U-shaped comprising three metal members. Each brace provides an anchor for the secondary linear actuators and functions to strengthen the respective board member to which it is attached.

The adjustable bed base further comprises a ramp assembly including two ramps joined by a connector. The ramps are moveable inside the channels of the side rails of the stationary frame.

The adjustable bed base further comprises two spacers secured to the foot rail of the stationary frame. The spacers enable the subframe described below to pivot about a pivot axis relative to the stationary frame.

The adjustable bed base further comprises a primary linear actuator for moving the ramp assembly from front to back. The primary linear actuator functions to raise and lower a front portion of the subframe, pivoting the subframe about the pivot axis. The pivot axis is defined by two pivot pins which secure pivot brackets secured to the rear member of the subframe to the spacers mentioned above.

The primary linear actuator has a first end pivotally secured to a mounting bracket secured to the middle rail of the stationary frame. The primary linear actuator has a second end pivotally secured to a mounting bracket secured to the connector of the ramp assembly. Upon being activated the primary linear actuator extends forwardly, pushing the ramp assembly forwardly, causing the ramps to move forwardly and the rotatable wheels to move up the grooves in the ramps. The movement of the ramp assembly raises the rotatable wheels which raises the rear member of the subframe. Thus, movement of the rotatable wheels up the ramps of the ramp assembly pivots the subframe about the pivot axis relative to the stationary frame, causing the subframe to incline.

The adjustable bed base further comprises front and rear secondary linear actuators. A front secondary linear actuator functions to incline the head deck board. The front secondary linear actuator has a first end pivotally secured to a mounting bracket secured to the cross member of the subframe. The second end of the front secondary linear actuator is pivotally secured to the head brace.

A rear secondary linear actuator functions to incline the leg and foot deck boards. The rear secondary linear actuator has a first end pivotally secured to a mounting bracket secured to the rear member of the subframe. The rear secondary linear actuator has a second end pivotally secured to the leg brace.

The three linear actuators are preferably motorized. The deck, whether articulated or flat, is inclined when the primary linear actuator is extended. The maximum incline or tilt occurs when the primary linear actuator is fully extended. The subframe is horizontal when the primary linear actuator is fully withdrawn or contracted. The primary linear actuator functions to incline the subframe regardless of whether the deck members are fully inclined or flat or any position therebetween.

Worded another way, the adjustable bed base comprises a stationary frame having opposed side rails, a head rail, a foot rail and a middle rail. Each of the side rails have a C-shaped cross-section defining a channel. Legs, which may or may not be adjustable in height, support the stationary frame. Spacers are secured to the foot rail of the stationary frame.

The adjustable bed base further comprises a ramp assembly, the ramp assembly includes two ramps joined by a connector. The ramps are moveable inside the channels of the side rails of the stationary frame.

The adjustable bed base further comprises a subframe pivotally secured to the spacers. The subframe comprises opposed side members, a front member, a rear member and a cross member. Rotatable wheels are secured to wheel mounting brackets which are secured to the front member of the subframe. The rotatable wheels are sized and adapted to move along the ramps of the ramp assembly.

The adjustable bed base further comprises a deck comprising a head deck board, a seat deck board, a leg deck board and a foot deck board hinged together. The seat deck board is secured to the stationary frame and remains stationary regardless of the positions of the other deck boards. A head brace is secured to the head deck board and a leg brace is secured to the leg deck board. Each brace provides an anchor for the secondary linear actuators and functions to strengthen the respective board member to which it is attached.

The adjustable bed base further comprises a primary linear actuator for moving the ramp assembly from front to back. The primary linear actuator functions to raise and lower a front portion of the subframe, pivoting the subframe about the pivot axis. The pivot axis is defined by two pivot pins which secure pivot brackets secured to the rear member of the subframe to the spacers mentioned above.

The primary linear actuator has a first end pivotally secured to a mounting bracket secured to the middle rail of the stationary frame. The primary linear actuator has a second end pivotally secured to a mounting bracket secured to the connector of the ramp assembly. Upon being activated the primary linear actuator extends forwardly, pushing the ramp assembly forwardly, causing the ramps to move forwardly and the rotatable wheels to move up the ramps. The forward movement of the ramp assembly raises the rotatable wheels which raises the front member of the subframe. Thus, movement of the rotatable wheels up the ramps of the ramp assembly pivots the subframe about the pivot axis relative to the stationary frame, causing the subframe to incline.

The adjustable bed base further comprises front and rear secondary linear actuators as described above for purposes of movement the deck boards.

The accompanying drawings, which are incorporated in and constitute a part of this specification, illustrate embodiments of the invention and, together with the summary of the invention given above, and the detailed description of the drawings given below, explain the principles of the present invention.

DETAILED DESCRIPTION OF THE INVENTION

Figure 1:
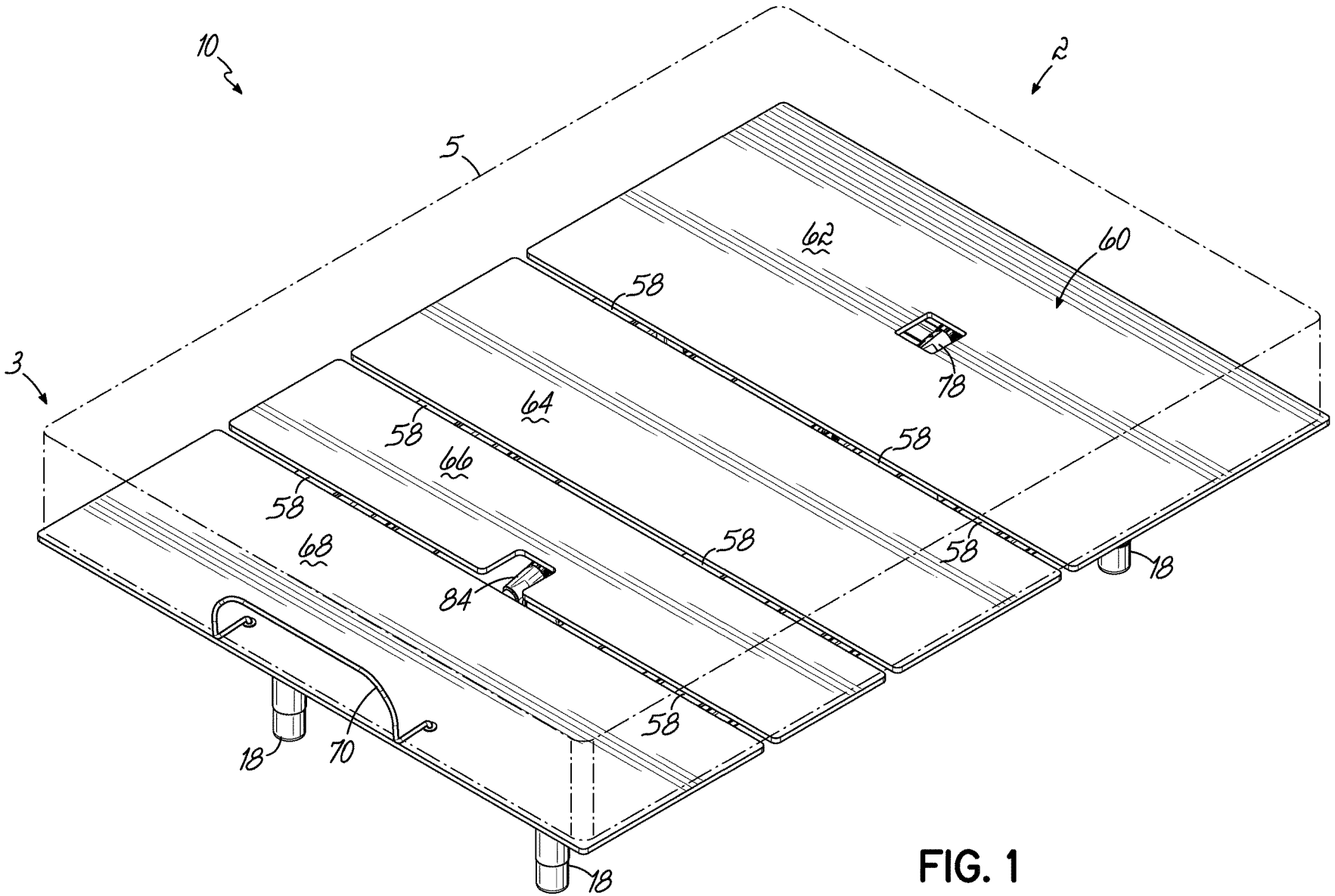
FIG. 1 is a top perspective view of an adjustable bed base.

Referring to FIG. 1, an adjustable bed 10 includes an adjustable bed base 12 for supporting a mattress 5. The adjustable bed base 12 has a head end 2 and a foot end 3. The adjustable bed base 12 of the present invention may be used with any type of mattress. The mattress is not intended to be limited by the drawings.

Figure 2:
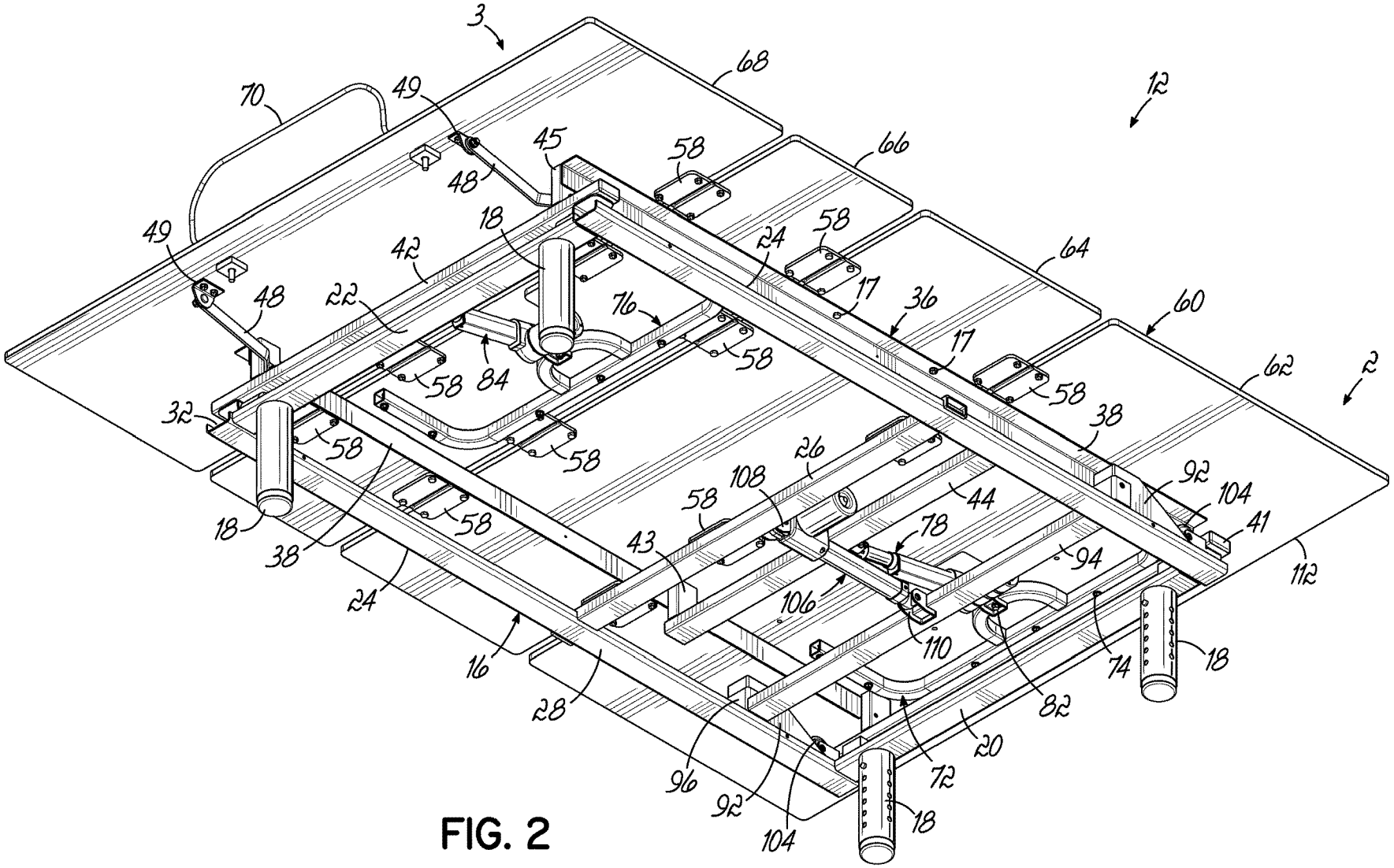
FIG. 2 is a bottom perspective view of the adjustable bed base of FIG. 1.

As best shown in FIG. 2, the adjustable bed base 12 comprises a generally rectangular stationary frame 16 supported by leg assemblies or legs 18. The leg assemblies 18 are illustrated as being adjustable in height. Although one type of leg assembly 18 is illustrated supporting the adjustable bed base 12, any other type of leg assembly including unitary legs not adjustable in height may be used in accordance with the present invention. The legs of the adjustable bed base are not intended to be limited by the drawings.

Figure 5:
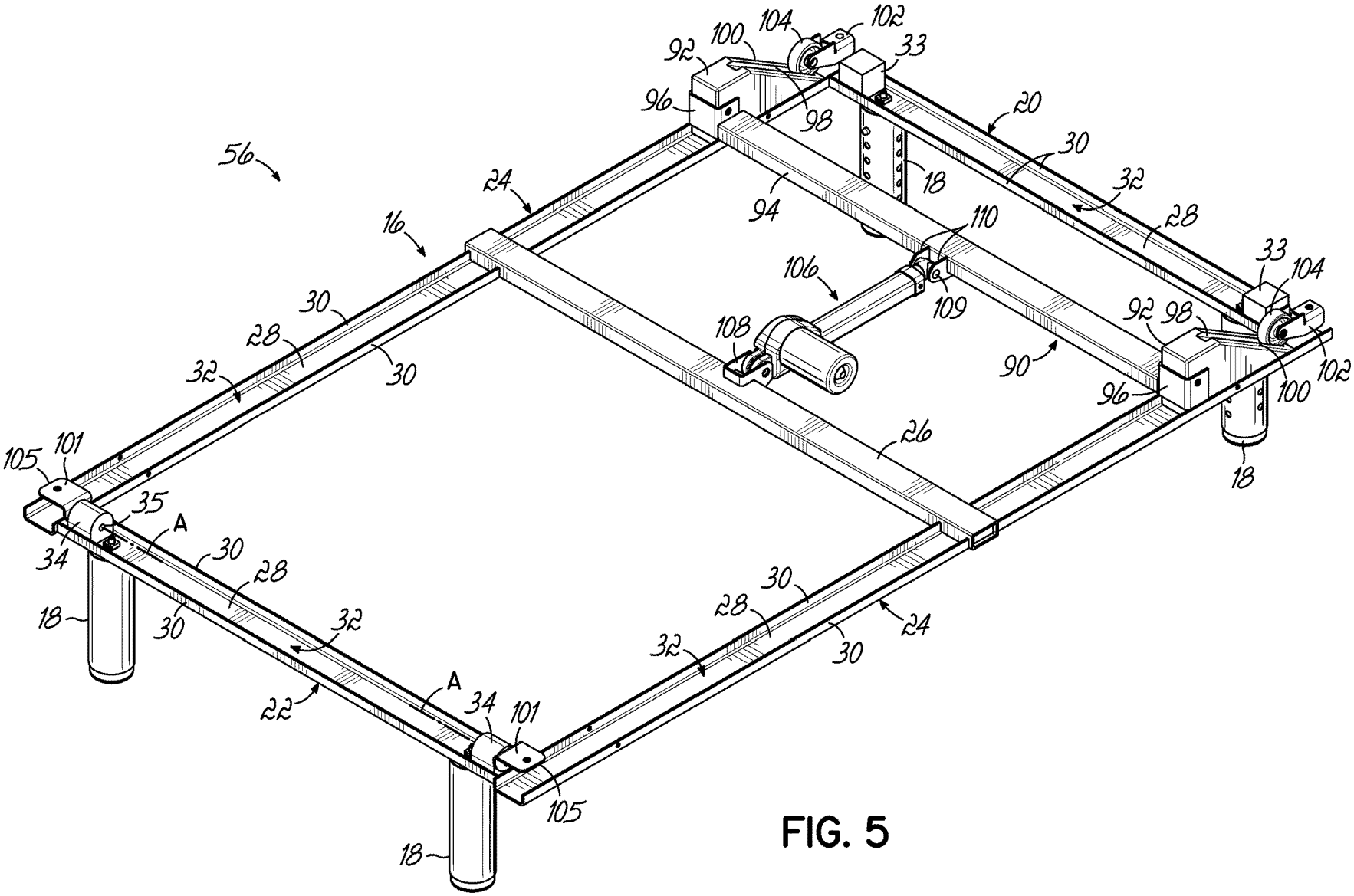
FIG. 5 is a perspective view of a portion of the frame assembly.

As best shown in FIG. 5, the generally rectangular stationary frame 16 comprises a head rail 20, a foot rail 22 and two opposed side rails 24. The head rail 20 and foot rails 22 each extend between the opposed side rails 24. As best shown in FIG. 5, the generally rectangular frame 16 further comprises a middle rail 26 extending between the opposed side rails 24. As best shown in FIG. 5, each of the side rails 24, the head rail 20 and foot rail 22 each have a C-shaped cross section comprising a bottom wall 28 and two side walls 30 extending upwardly from the bottom wall 28 which define a channel 32.

Figure 5A:
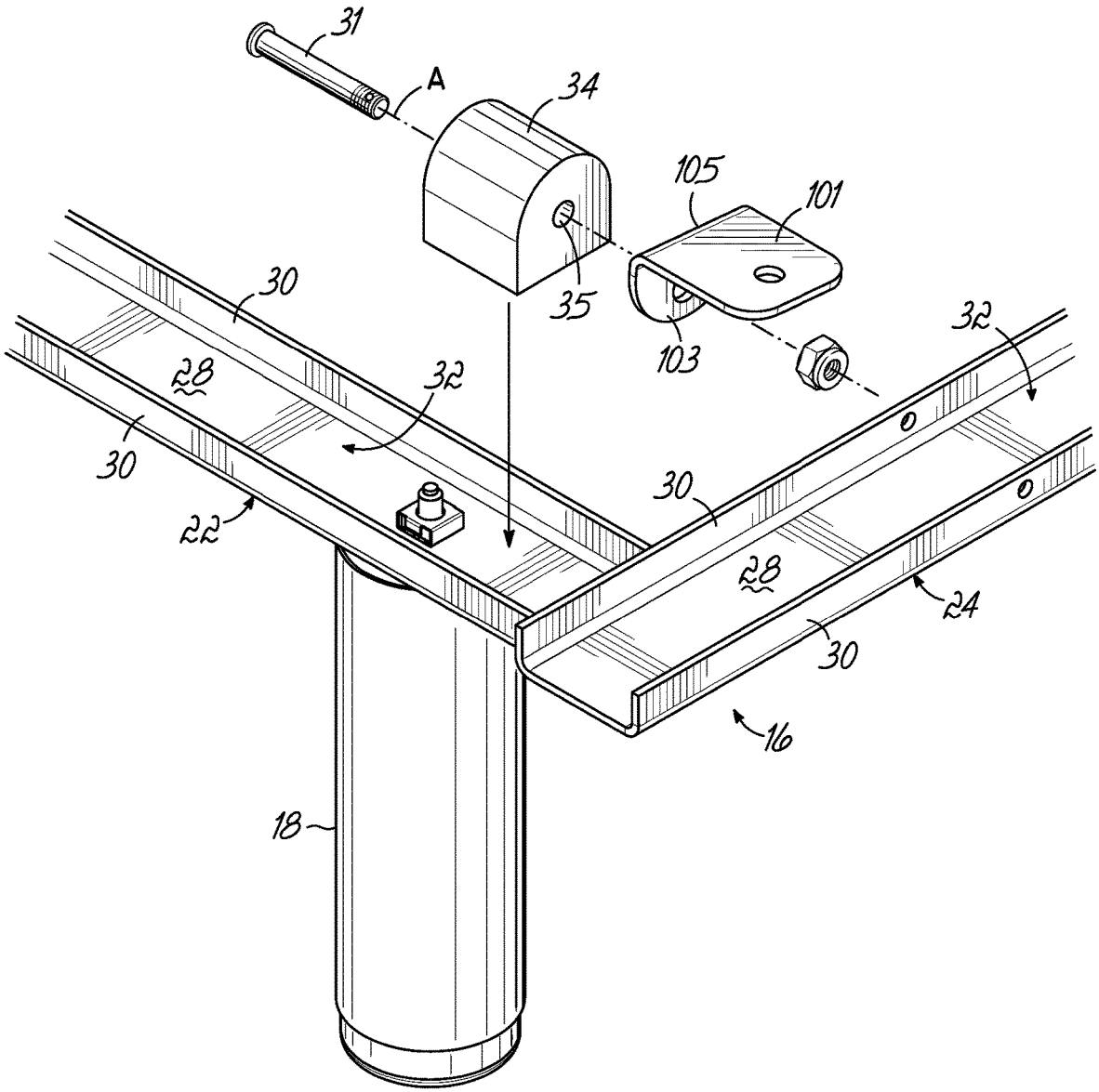
FIG. 5A is an enlarged disassembled perspective view of a corner portion of the frame assembly shown in FIG. 5.

As best shown in FIG. 5, the adjustable bed base 12 further comprises two rear spacers 34 secured inside the channel 32 of the foot rail 22 of the stationary frame 16 and two front spacers 33 inside the channel 32 of the head rail 20 of the stationary frame 16. As best seen in FIG. 5A, each of the rear spacers 34 is generally shaped like a cylinder and has an opening 35 extending through the spacer 34. The opening 35 is adapted to allow a threaded fastener 31 to pass through the opening 35. The rear spacers 34 are preferably made of metal but may be made of any other material. Although each of the front spacers 33 is block shaped, it may be any desired shape.

Figure 4:
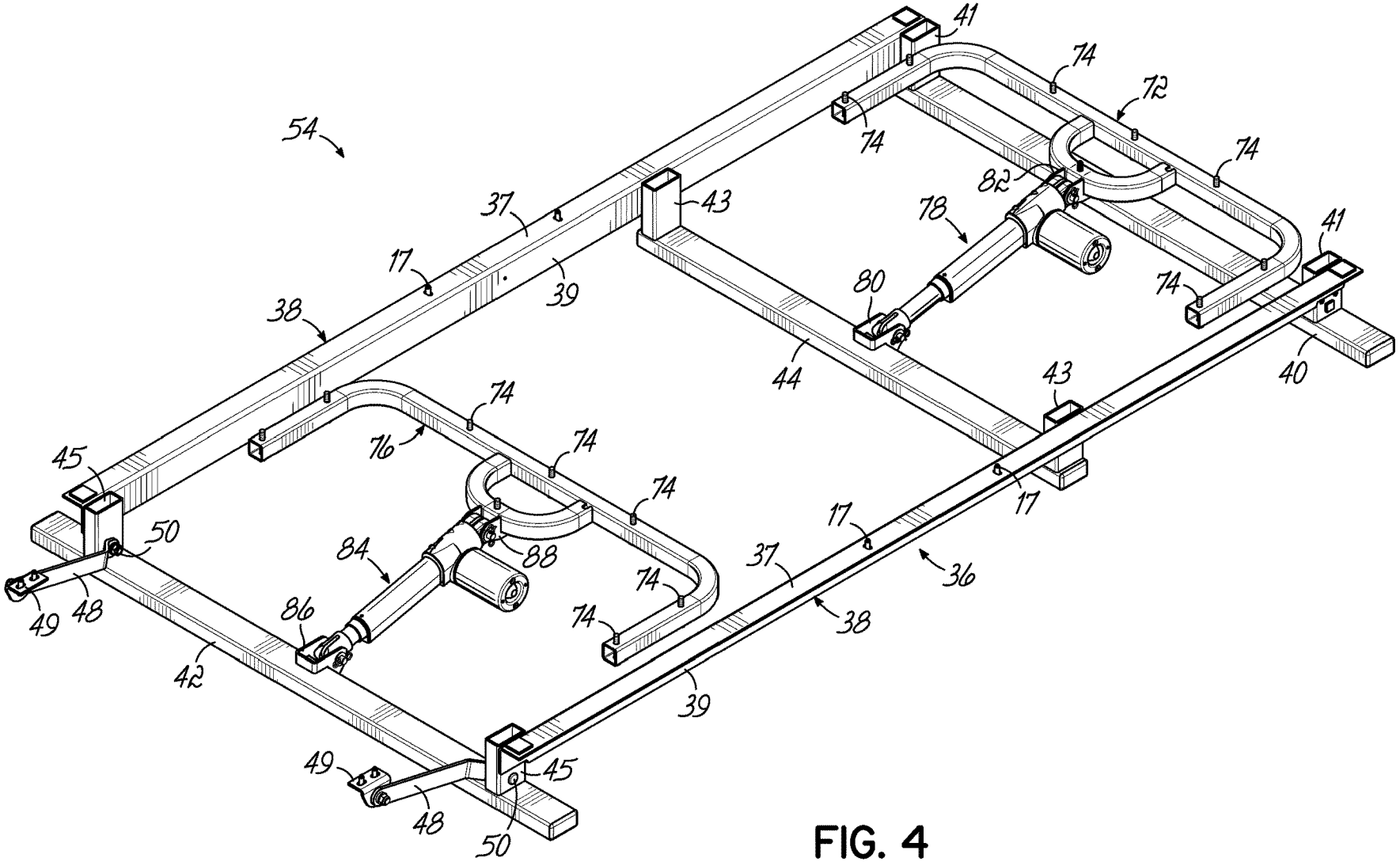
FIG. 4 is a perspective view of a portion of the subframe assembly.

As best shown in FIG. 4, the adjustable bed base 12 further comprises a subframe 36 comprising opposed side members 38, a front member 40, a rear member 42 and a cross member 44. Although FIG. 4 shows each of the opposed side members 38 being an angled metal member having an L-shaped cross section including a horizontal flange 37 and a vertical flange 39, one or more of these side members 38 may be shaped differently than as shown. As best shown in FIG. 4, the front member 40 is spaced below the side members 38 with stubs 41 welded to the side members 38 and front member 40. Similarly, the cross member 44 is spaced below the side members 38 with stubs 43 welded to the side members 38 and cross member 44. Lastly, the rear member 42 is spaced below the side members 38 with stubs 45 welded to the side members 38 and rear member 42. Although each of the stubs 41, 43 and 45 is illustrated being a hollow member, some of the stubs may be solid members or shapes other than those shown in the drawings.

As best shown in FIG. 4, the subframe 36 also includes two foot links 48. As shown in FIG. 4, each of the foot links 48 is pivotal about a horizontal axis defined by a fastener 50, the fastener 50 extending through one of the stubs 45 secured to the rear member 42 of the subframe 36. The other end of each of the foot links 48 is pivotally secured to a mounting bracket 49 secured to the foot deck board 68 described below.

Figure 3:
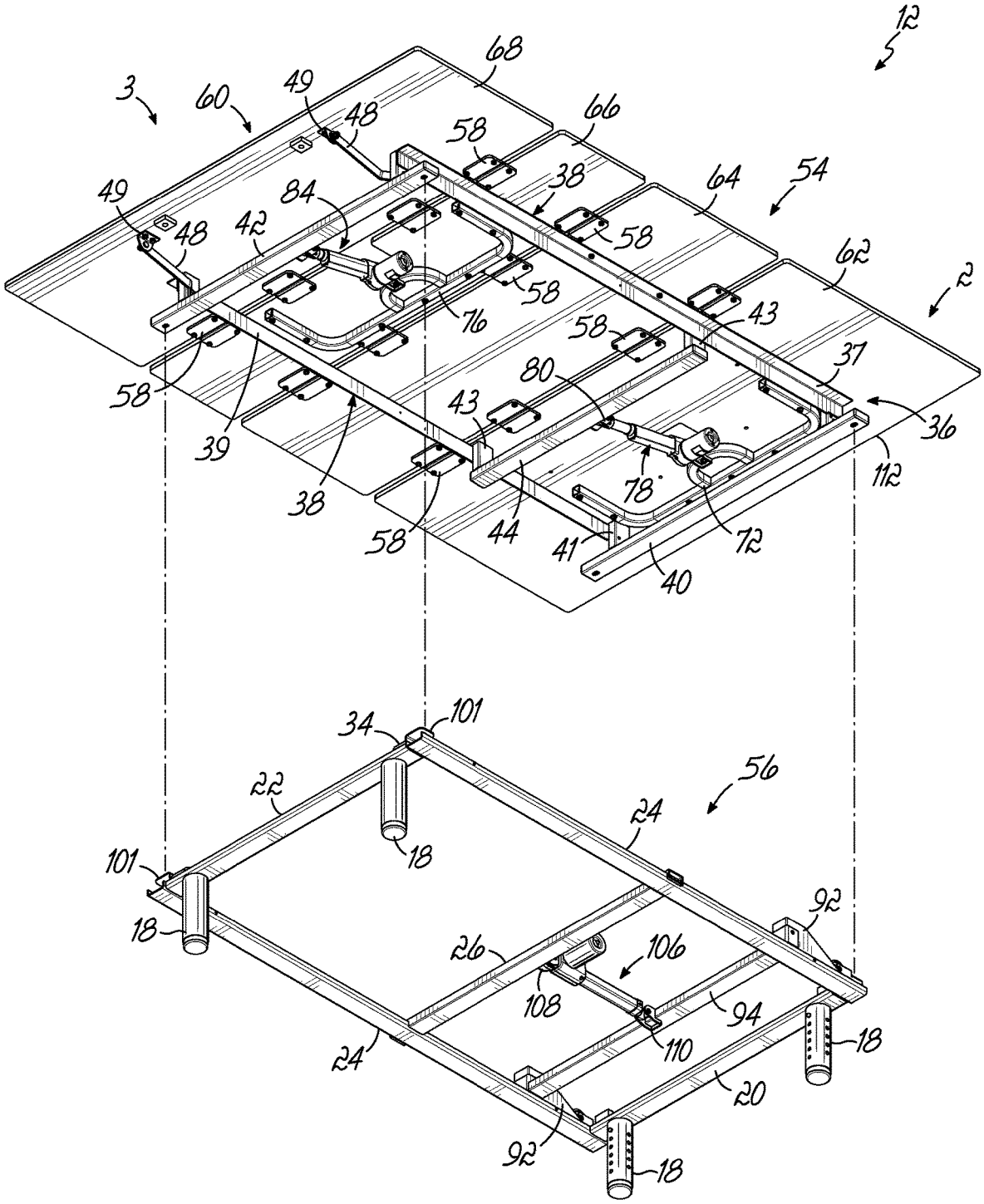
FIG. 3 is a bottom perspective view of a subframe assembly of the adjustable bed base separated from a frame assembly of the adjustable bed base.

As best shown in FIG. 3, the subframe 36 is part of a subframe assembly 54 for purposes of this document. Although not shown in FIG. 4, the deck 60 is part of the subframe assembly 54. Although shown in FIG. 4, wheel mounting brackets and rotatable wheels are part of the subframe assembly 54 for purposes of this document. FIG. 4 shows an enlarged view of the subframe assembly 54 without the articulated deck. FIG. 5 shows an enlarged view of the frame assembly 56.

As best shown in FIGS. 1 and 2, the adjustable bed base 12 further comprises an articulating deck 60 comprising a head deck board 62 hinged to a seat deck board 64 with hinges 58. As best shown in FIG. 2, the seat deck board 64 is secured to the side members 38 of the subframe 36 with fasteners 17 and does not move when the deck 60 is articulated. See FIGS. 6A-6D. A leg deck board 66 is hinged to the seat deck board 64 with hinges 58. Lastly, a foot deck board 68 is hinged to the leg deck board 66 with hinges 58. Although four hinges 58 are shown securing adjacent deck boards, any other number of hinges may be used.

As best shown in FIG. 1, a stop 70 is secured to the foot deck board 68 of the deck 60 and functions to prevent movement of the mattress 5 relative to the adjustable bed base 12 when the deck 60 is articulated.

As best shown in FIGS. 3 and 4, the subframe assembly 54 of the adjustable bed base 12 further comprises a generally U-shaped head brace 72 secured to the underside of the head deck board 62 with fasteners 74. The subframe assembly 54 of the adjustable bed base 12 further comprises a generally U-shaped leg brace 76 secured to the underside of the leg deck board 66 with fasteners 74. As best shown in FIG. 4, although each of the head and leg braces 72, 76 respectively, is shown as comprising multiple pieces of hollow metal, either of the head and leg braces 72, 76 respectively, may be made of any number of pieces of any known material. The generally U-shaped head brace 72 functions to strengthen the head deck board 62 and provide an anchor for the linear actuator described below. Similarly, the generally U-shaped leg brace 76 functions to strengthen the leg deck board 66 and provide an anchor for the other linear actuator described below.

Although the head brace 72 and leg brace 76 are illustrated being a certain shape, they may be any other shape. The drawings are not intended to limit the size or shape of either the head brace 72 or leg brace 76.

As best shown in FIG. 4, the subframe assembly 54 of the adjustable bed base 12 further comprises a motorized front secondary linear actuator 78 for inclining the head deck board 62. The motorized front secondary linear actuator 78 has a rear or first end pivotally secured to a mounting bracket 80 secured to the cross member 44 of the subframe 36. The motorized front secondary linear actuator 78 has a front or second end pivotally secured to a mounting portion 82 of the generally U-shaped head brace 72. Although the mounting portion 82 is shown as two spaced ears, it may be any other desired shape. Again, the drawings are not intended to be limiting.

As best shown in FIG. 4, the subframe assembly 54 of the adjustable bed base 12 further comprises a motorized rear secondary linear actuator 84 for inclining the leg deck board 66, which in turn inclines the foot deck board 68. The motorized rear secondary linear actuator 84 has a rear or first end pivotally secured to a mounting bracket 86 secured to the rear member 42 of the subframe 36. The motorized rear secondary linear actuator 84 has a front or second end pivotally secured to a mounting portion 88 of the generally U-shaped leg brace 76. Although the mounting portion 88 is shown as two spaced ears, it may be any other desired shape. Again, the drawings are not intended to be limiting.

Although not shown, either end of either the front or rear secondary linear actuator 78, 84 may be secured to a mounting bracket. For example, the front or second end of motorized front secondary linear actuator 78 may be secured to a mounting bracket secured to the generally U-shaped head brace 72, rather than being secured to a mounting portion 82 of the generally U-shaped head brace 72.

Likewise, the front or second end of motorized rear secondary linear actuator 84 may be secured to a mounting bracket secured to the generally U-shaped leg brace 76, rather than being secured to a mounting portion 88 of the generally U-shaped leg brace 76.

Referring to FIG. 5, the frame assembly 56 includes the stationary frame 16 described above. As best seen in FIG. 5, the adjustable bed base 12 further comprises a ramp assembly 90 which is part of the frame assembly 56. The ramp assembly 90 comprises ramps 92 joined by a connector 94. As best shown in FIG. 5, connector 94 includes brackets 96 at the outer ends thereof sized and adapted to receive the ramps 92. Each of the ramps 92 has a groove 98 extending along an inclined surface 100 of the ramp 92. Each of the ramps 92 is sized to be moveable inside one of the channels 32 of one of the side rails 24 of stationary frame 16.

Although shown in FIG. 5, rather than FIG. 4 for ease of understanding, the subframe assembly 54 of the adjustable bed base 12 further comprises wheel mounting brackets 102 secured to the front member 40 of the subframe 36. More particularly, the wheel mounting brackets 102 are secured to the lower surface of the front member 40 of the subframe 36. See FIG. 4. As best shown in FIG. 5, a rotatable wheel 104 is secured to each of the wheel mounting brackets 102. Each of the rotatable wheels 104 is sized to fit inside the groove 98 of one of the ramps 92 and move therein. The grooves 98 of the ramps 92 guide the movement of the rotational wheels 104 when the motorized primary linear actuator 106 is actuated.

FIG. 5 further shows a pair of pivot brackets 105 at the foot end of the adjustable bed base 12. As best shown in FIG. 5A, each pivot bracket 105 is generally L-shaped and comprises a top portion 101 which is secured to a lower surface of the rear member 42 of the subframe 36. Each pivot bracket 105 further comprises a side portion 103 which is secured to one of the rear spacers 34 with a threaded fastener 31 which extends through opening 35 of the rear spacer 34. The two threaded fasteners 31 (one per spacer 34) are aligned and define a pivot axis A about which the subframe 36 pivots relative to the stationary frame 16.

As best shown in FIG. 5, the frame assembly 56 further comprises a motorized primary linear actuator 106 for raising and lowering the front member 40 of the subframe 36 in order to pivot the subframe 36 about the pivot axis A defined by fasteners 31. The motorized primary linear actuator 106 has a rear end pivotally secured to a mounting bracket 108. The mounting bracket 108 is secured to the middle rail 26 of the stationary frame 16. The motorized primary linear actuator 106 has a front end pivotally secured to a pin 109 extending between spaced ears 110 extending rearwardly from the connector 100 of the ramp assembly 90. Although not shown a mounting bracket may be used to join a connector of a ramp assembly and the front end of the motorized primary linear actuator 106.

Figure 6A:
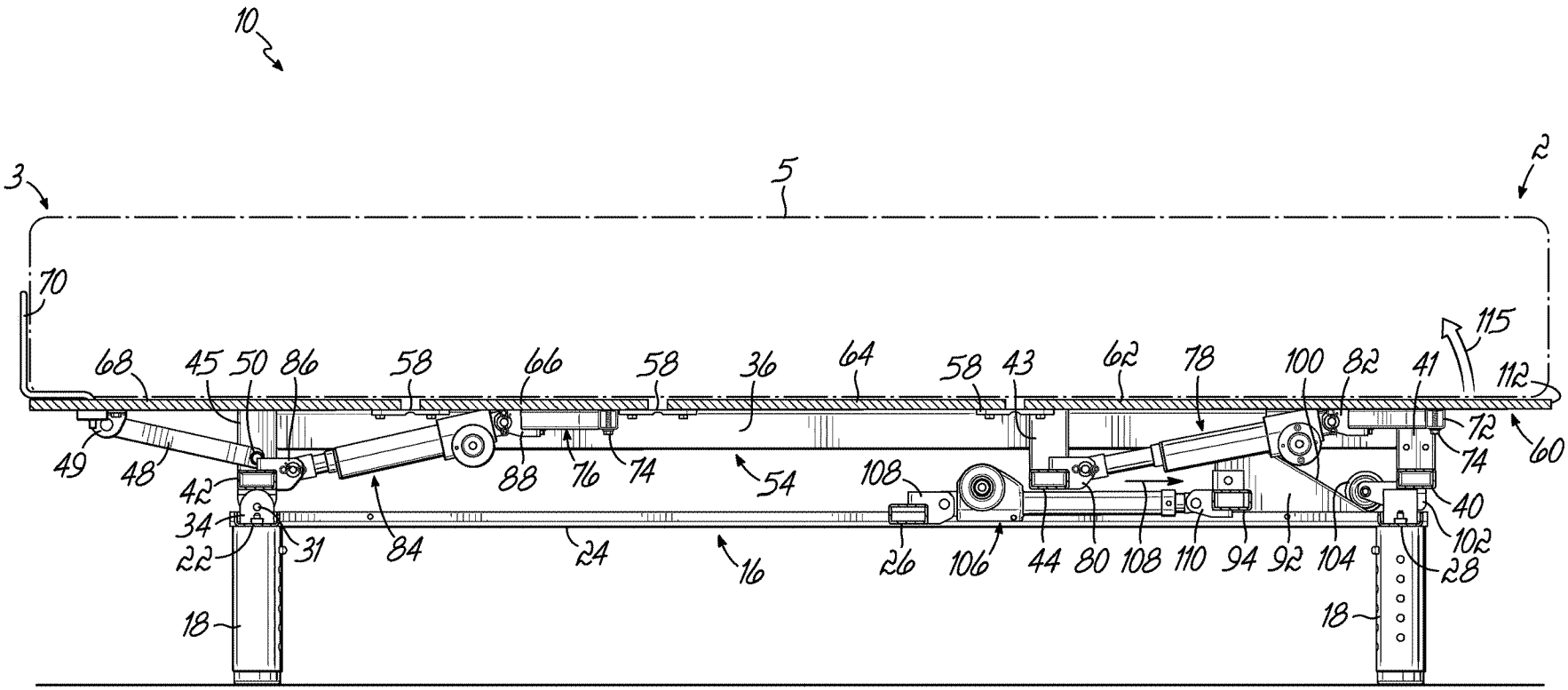
FIG. 6A is a longitudinal cross-sectional view of the adjustable bed base showing the subframe in a lowered horizontal position and the deck members co-planar.
Figure 6B:
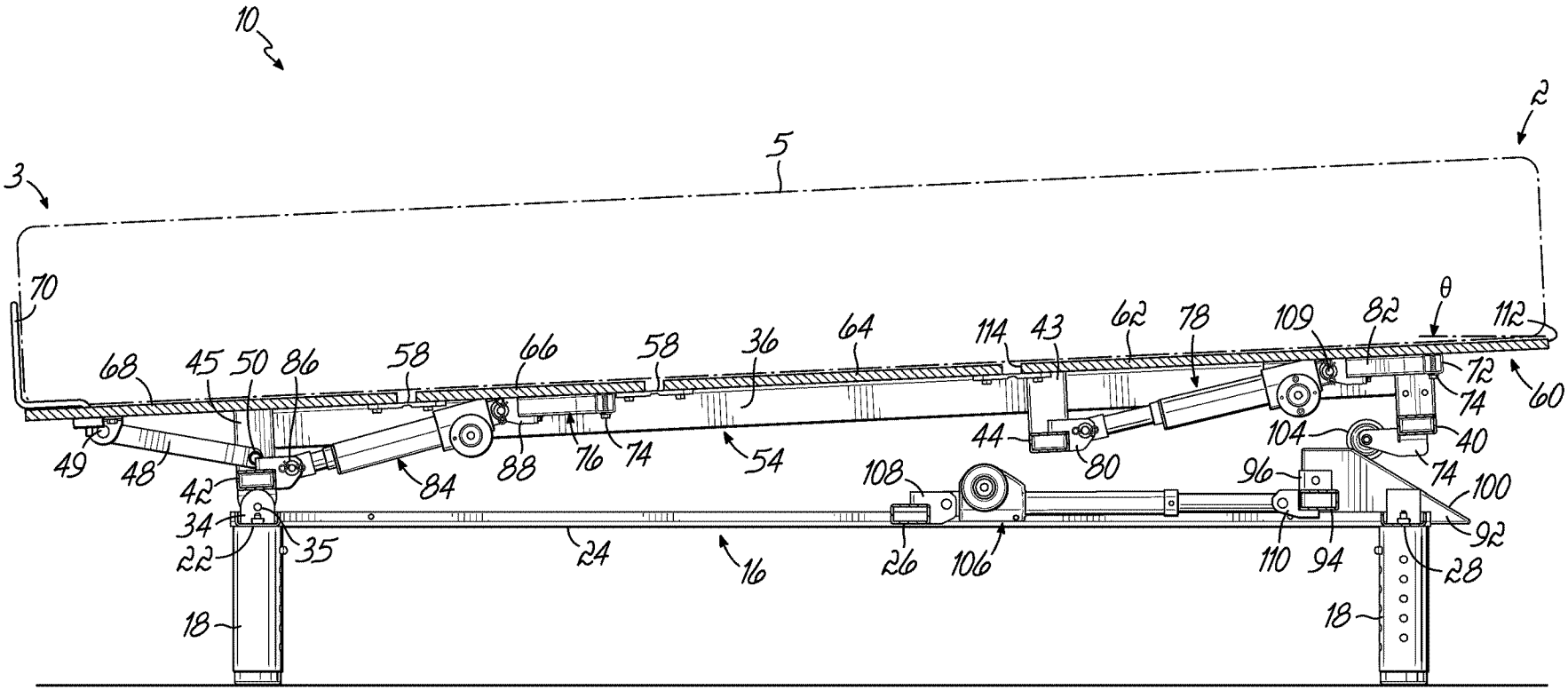
FIG. 6B is a longitudinal cross-sectional view of the adjustable bed base showing the subframe in an inclined position and the deck members co-planar.

FIGS. 6A and 6B show two different positions of the adjustable bed base 12, each with the deck 60 being flat or the deck members being co-planar. FIGS. 6A and 6B also show a method of operation of the adjustable bed base 12. FIG. 6A shows the adjustable bed base 12 in a home position with the subframe 36 is its lowered, horizontal position. In this home position, the motorized primary lift actuator 106 is fully retracted and not activated. From this home position shown in FIG. 6A, the motorized primary linear actuator 106 of adjustable bed base 12 is activated via remote control (not shown) or an app on a phone (not shown) to expand or lengthen. Such expansion of the primary linear actuator 106 shown by arrow 108 in FIG. 6A, moves the ramp assembly 90 forwardly. The forward movement of the connector 94 of the connector assembly 90 by expansion of the primary linear actuator 106 moves the ramps 92 forward in the channels 34 of the side rails 24 of stationary frame 16. This forward movement of the ramps 92 causes the wheels 104 of the subframe 36 to move upwardly inside the grooves 98 of the ramps 92. This upward movement of the wheels 104 raises the front member 40 of subframe 36 in the direction shown by arrow 115 of FIG. 6A to its fully inclined position shown in FIG. 6B. This movement of the wheels 104 causes the front member 40 of subframe 36 to rise upwardly, thereby pivoting the subframe 36 about pivot axis A to its fully inclined position shown in FIG. 6B. FIG. 6B shows the deck 60 in a flat position and the subframe 36 in its fully inclined position due to full extension of the primary lift actuator 106.

FIG. 6B illustrates the deck 60 in a flat position with the deck boards being co-planar. However, the deck 60 is in a tilted or inclined position with a front edge 112 of the head deck board 62 being above a rear edge 114 of the head deck board 62. The same is true for each of the deck boards. In the industry this is known as a Reverse Trendelenburg position. When the adjustable bed base 12 is in this position shown in FIG. 6B, the subframe 36 and each of the deck boards is inclined at an angle θ which may be up to six degrees relative to horizontal. In this inclined position shown in FIG. 6B, the primary lift actuator 106 is fully extended.

In each of the positions shown in FIGS. 6A and 6B, the front and rear secondary linear actuators 78, 84, respectively, are in their retracted position and are not activated, thereby resulting in a flat deck 60.

Figure 6C:
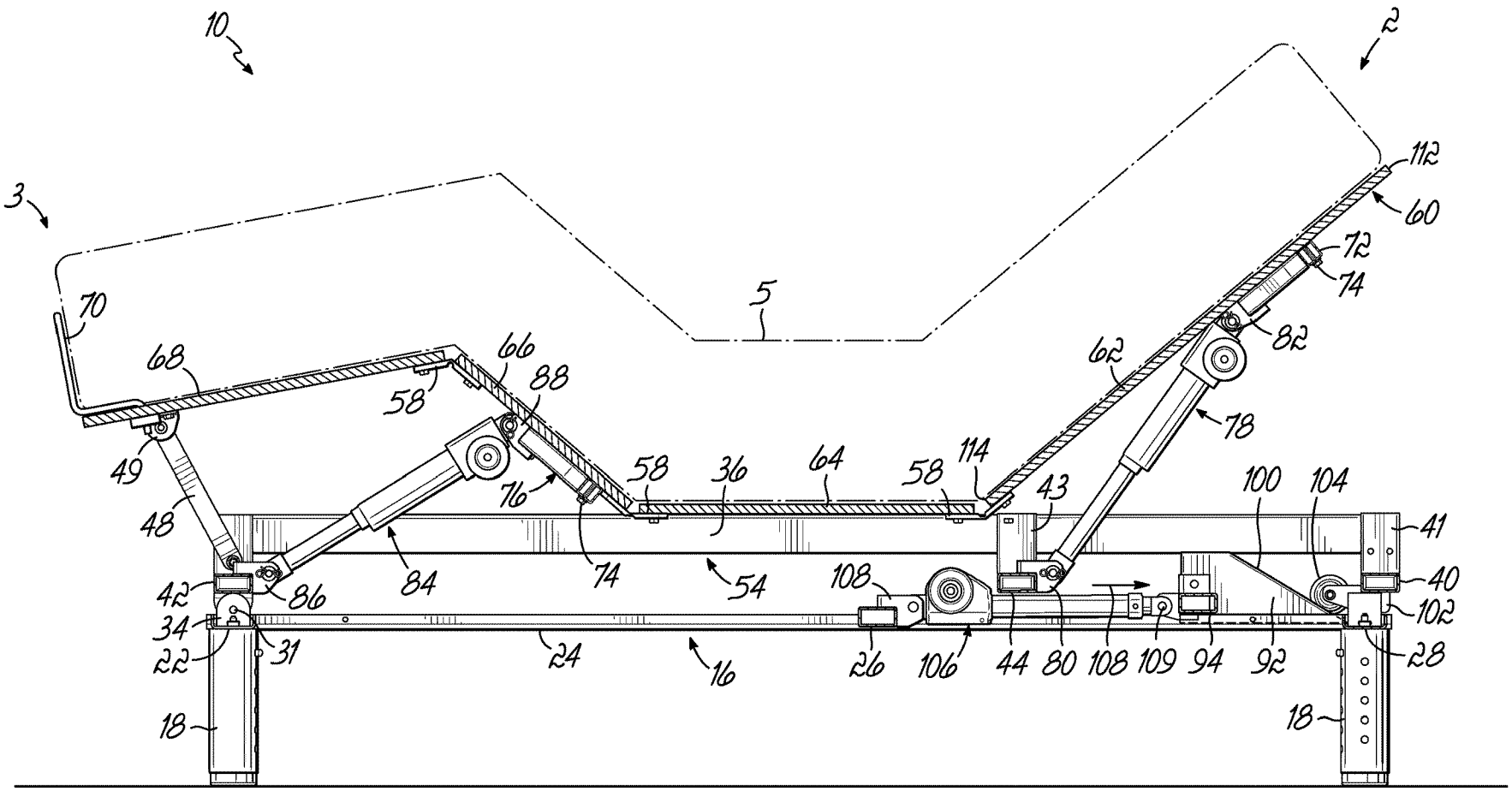
FIG. 6C is a longitudinal cross-sectional view of the adjustable bed base showing the subframe in a lowered horizontal position and the deck members fully inclined.
Figure 6D:
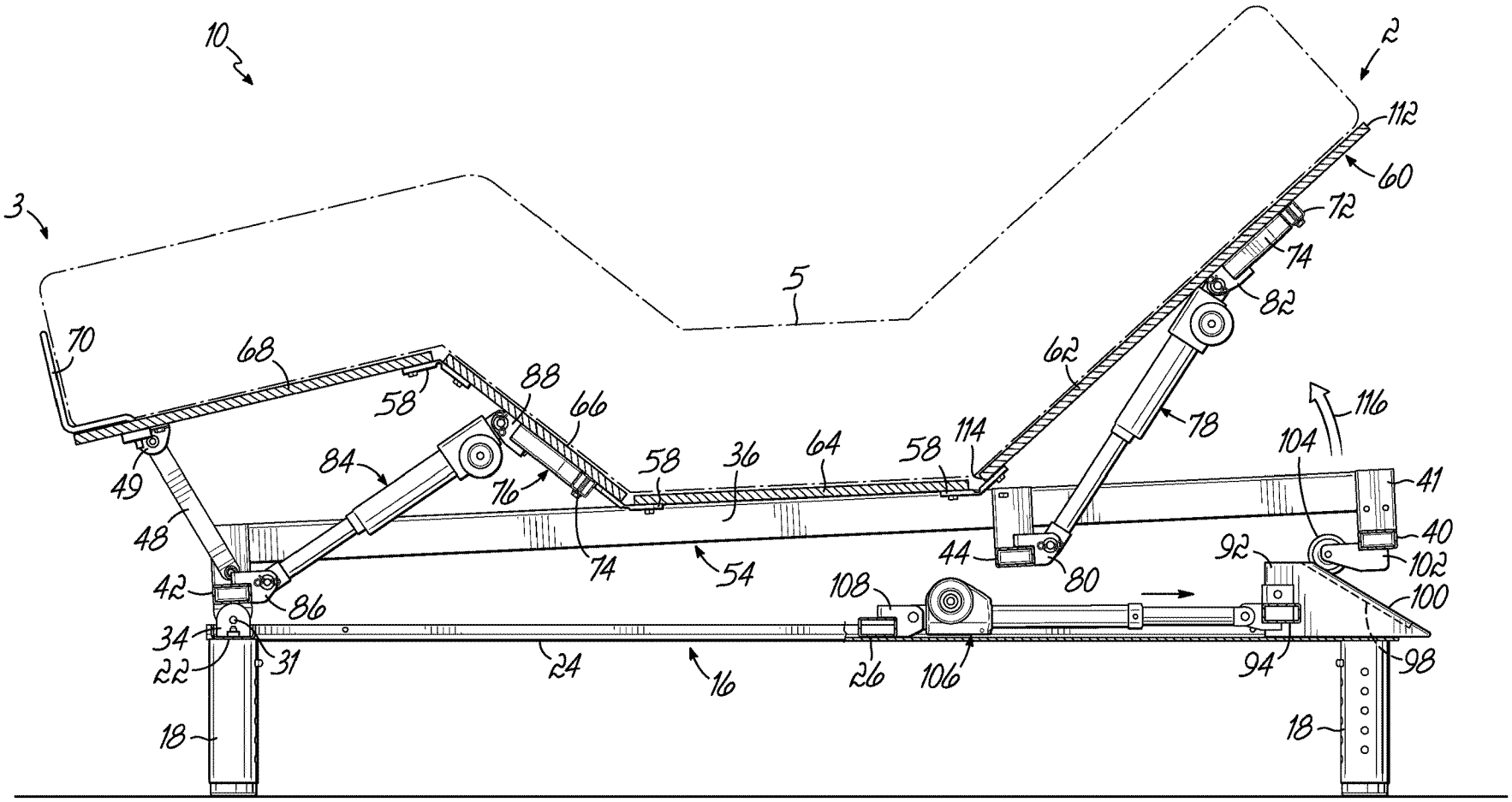
FIG. 6D is a longitudinal cross-sectional view of the adjustable bed base showing the subframe in an inclined position and the deck members fully inclined.

FIGS. 6C and 6D correspond to FIGS. 6A and 6B with the subframe 36 in the same respective positions. However, the deck 60 is shown in FIGS. 6C and 6D fully inclined or articulated. In other words, the front and rear secondary linear actuators 78, 84, respectively, are fully extended in FIGS. 6C and 6D. However, In FIG. 6C, the primary lift actuator 106 is not activated and fully retracted. In FIG. 6D, the primary lift actuator 106 is activated and fully extended.

FIG. 6C shows the adjustable bed base 12 in a home position with the subframe 36 is its lowered position like FIG. 6A. In this home position, the primary lift actuator 106 is fully retracted. From this home position shown in FIG. 6C, the primary linear actuator 106 of adjustable bed base 12 is activated via remote control (not shown) or phone app (not shown) to expand or lengthen. Such expansion of the primary linear actuator 106 shown by arrow 108 in FIG. 6C, causes movement of the ramps 92 forwardly, moving the wheels 104 in grooves 98 upwardly. This movement of the wheels 104 causes the front member 40 of subframe 36 to move upwardly, thereby pivoting the subframe 36 to its fully inclined position shown in FIGS. 7B and 7D.

FIG. 6C illustrates the articulated deck 60 in a fully inclined position with the head, leg and foot deck boards 62, 66, 68 being fully inclined due to full extension of the front and rear secondary lift actuators 78, 84, respectively. However, the articulated deck 60 is in a first tilted position with the front edge 112 of the head deck board 62 being above the rear edge 114 of the head deck board 62. When the adjustable bed base 12 is in the position shown in FIG. 6D, the subframe 36 is inclined with the motorized primary linear actuator 106 fully extended. In this inclined position shown in FIG. 6D, the front and rear secondary lift actuators 78, 84, respectively, are too fully extended.

Although not shown, regardless of whether the subframe 36 is inclined or horizontal, only one, rather than both, of the front and rear secondary lift actuators 78, 84, respectively, may be partially or fully extended, thereby moving the deck boards to desired positions.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. An adjustable bed base comprising:

a generally rectangular stationary frame having opposed side rails, a head rail, a foot rail, a middle rail and a ramp assembly, each of the side rails having a C-shaped cross-section defining a channel;

the ramp assembly including two ramps joined by a connector, the ramps being movable inside the channels of the side rails of the stationary frame;

a subframe pivotally secured to the stationary frame, the subframe having opposed side members, a front member, a rear member and a cross member;

rotatable wheels secured to mounting brackets secured to the front member of the subframe, the rotatable wheels being sized and adapted to move inside grooves of the ramps of the ramp assembly;

a deck comprising a head deck board, a seat deck board, a leg deck board and a foot deck board hinged together, the seat deck board being secured to the subframe;

a head brace secured to the head deck board;

a leg brace secured to the leg deck board;

a primary linear actuator for moving the ramp assembly, the primary linear actuator having a first end pivotally secured to a mounting bracket secured to the middle rail of the stationary frame and a second end pivotally secured to a mounting bracket secured to the connector of the ramp assembly;

a front secondary linear actuator for inclining the head deck board, the front secondary linear actuator having a first end pivotally secured to a mounting bracket secured to the cross member of the subframe and a second end pivotally secured to the head brace;

a rear secondary linear actuator for inclining the leg and foot deck boards, the rear secondary linear actuator having a first end pivotally secured to a mounting bracket secured to the rear member of the subframe and a second end pivotally secured to the leg brace; and legs secured to the stationary frame for supporting the stationary frame.

2. The adjustable bed base of claim 1, further comprising foot links extending between the foot member of the subframe and brackets secured to the foot deck board.

3. The adjustable bed base of claim 1, wherein the head and leg braces are generally U-shaped.

4. The adjustable bed base of claim 1, wherein the linear actuators are motorized.

5. The adjustable bed base of claim 1, the opposed side members of the subframe are angle irons.

6. The adjustable bed base of claim 1, wherein the deck is tilted when the primary linear actuator is fully extended.

7. The adjustable bed base of claim 1, wherein the deck is articulated when the front and rear secondary linear actuators are fully extended.

8. An adjustable bed base comprising:

a stationary frame having opposed side rails, a head rail, a foot rail and a middle rail, each of the side rails having a C-shaped cross-section defining a channel;

a ramp assembly including two ramps joined by a connector, the ramps being movable inside the channels of the side rails of the stationary frame;

spacers secured to the foot rail of the stationary frame;

a subframe pivotally secured to the spacers, the subframe having opposed side members, a front member, a rear member and a cross member;

rotatable wheels secured to wheel mounting brackets secured to the front member of the subframe, the rotatable wheels being sized and adapted to move along the ramps of the ramp assembly;

a deck comprising a head deck board, a seat deck board, a leg deck board and a foot deck board hinged together, the seat deck board being secured to the subframe;

a head brace secured to the head deck board;

a leg brace secured to the leg deck board;

a primary linear actuator for moving the ramp assembly, the primary linear actuator having a first end pivotally secured to a mounting bracket secured to the middle rail of the stationary frame and a second end pivotally secured to a mounting bracket secured to the connector of the ramp assembly;

a front secondary linear actuator for inclining the head deck board, the front secondary linear actuator having a first end pivotally secured to a mounting bracket secured to the cross member of the subframe and a second end pivotally secured to the head brace;

a rear secondary linear actuator for inclining the leg and foot deck boards, the rear secondary linear actuator having a first end pivotally secured to a mounting bracket secured to the rear member of the subframe and a second end pivotally secured to the leg brace.

9. The adjustable bed base of claim 8, further comprising legs secured to the stationary frame for supporting the stationary frame.

10. The adjustable bed base of claim 9, wherein the linear actuators are motorized.

11. The adjustable bed base of claim 8, wherein the adjustable bed base has two pins defining a pivot axis of movement of the subframe relative to the stationary frame.

12. The adjustable bed base of claim 11, wherein the pins extend through the spacers.

13. The adjustable bed base of claim 8, wherein the ramps have grooves in which the wheels move.

14. The adjustable bed base of claim 8, wherein the subframe is inclined when the primary linear actuator is extended.

15. The adjustable bed base of claim 8, wherein the front and rear members of the subframe are below the side members of the subframe.

16. An adjustable bed base comprising:

a stationary frame having opposed side rails, a head rail, a foot rail and a middle rail, each of the rails having a C-shaped cross-section defining a channel;

a subframe pivotal relative to the stationary frame, the subframe having opposed side members, a front member, a rear member and a cross member extending between the opposed side members, a movable ramp assembly including two ramps joined by a connector, the ramps being movable inside the channels of the side rails of the stationary frame, rotatable wheels secured to mounting brackets secured to the front member of the subframe, the rotatable wheels being sized and adapted to move along the ramps of the ramp assembly to incline the subframe relative to the stationary frame;

a deck comprising a head deck board, a seat deck board, a leg deck board and a foot deck board hinged together, the seat deck board being secured to the subframe;

a head brace secured to the head deck board;

a leg brace secured to the leg deck board;

a primary linear actuator for moving the ramp assembly, the primary linear actuator having a first end pivotally secured to a mounting bracket secured to the middle rail of the stationary frame and a second end pivotally secured to a mounting bracket secured to the connector of the ramp assembly;

a front secondary linear actuator for inclining the head deck board, the front secondary linear actuator having a first end pivotally secured to a mounting bracket secured to the cross member of the subframe and a second end pivotally secured to the head brace;

a rear secondary linear actuator for inclining the leg and foot deck boards, the rear secondary linear actuator having a first end pivotally secured to a mounting bracket secured to the rear member of the subframe and a second end pivotally secured to the leg brace.

17. The adjustable bed base of claim 16, further comprising spacers secured to the foot rail of stationary frame and pivot brackets secured to the rear member of the subframe, each of the pivot brackets being pivotally secured to one of the spacers secured to the stationary frame.

18. The adjustable bed base of claim 17, wherein pins extend through the spacers and pivot brackets, the pins defining a pivot axis.

19. The adjustable bed base of claim 16, wherein the subframe is horizontal when the primary linear actuator is retracted.

20. The adjustable bed base of claim 16, wherein the subframe is inclined when the primary linear actuator is extended.

* * * * *